US012605641B2

(12) United States Patent
Park et al.

(10) Patent No.: US 12,605,641 B2
(45) Date of Patent: Apr. 21, 2026

(54) AUDIO OUTPUT SYSTEM AND METHOD FOR CHANGING SOUND CONTENT THEREOF

(71) Applicant: KOKOZI CO., LTD, Seoul (KR)

(72) Inventors: Ji Hee Park, Seoul (KR); Ki Un Choi, Seoul (KR)

(73) Assignee: KOKOZI CO., LTD, Seoul (KR)

( * ) Notice: Subject to any disclaimer, the term of this patent is extended or adjusted under 35 U.S.C. 154(b) by 0 days.

(21) Appl. No.: 18/864,892

(22) PCT Filed: Apr. 27, 2023

(86) PCT No.: PCT/KR2023/005818
§ 371 (c)(1),
(2) Date: Nov. 11, 2024

(87) PCT Pub. No.: WO2023/214742
PCT Pub. Date: Nov. 9, 2023

(65) Prior Publication Data

US 2025/0222368 A1 Jul. 10, 2025

(30) Foreign Application Priority Data

May 6, 2022 (KR) ..... 10-2022-0056150

(51) Int. Cl.
*A63H 3/28* (2006.01)
*A63H 3/00* (2006.01)
(Continued)

(52) U.S. Cl.
CPC ..... *A63H 3/28* (2013.01); *A63H 3/00* (2013.01); *A63H 3/003* (2013.01); *A63H 3/52* (2013.01);
(Continued)

(58) Field of Classification Search
CPC . A63H 5/00; A63H 3/28; A63H 3/003; A63H 3/52; A63H 3/00; A63H 2200/00; A63H 33/26; A63H 30/04; A63H 30/02
See application file for complete search history.

(56) References Cited

U.S. PATENT DOCUMENTS 6,415,439 B1 * 7/2002 Randell ..... H04L 65/70 725/74
6,742,188 B1 * 5/2004 Del Castillo ..... G08C 17/02 348/460
(Continued)

FOREIGN PATENT DOCUMENTS

KR 100894569 B1 4/2009
KR 20180012561 A 2/2018
(Continued)

OTHER PUBLICATIONS

International Search Report for International Application No. PCT/KR2023/005818.
(Continued)

*Primary Examiner* — William H McCulloch, Jr.
(74) *Attorney, Agent, or Firm* — Perilla Knox & Hildebrandt LLP; Thomas B. Hildebrandt

(57) ABSTRACT

An audio output system comprising: an audio output device configured to output sound content for auditory stimulation of infants and young children; a user device configured to control the audio output device; and a server connected to the user device and the audio output device through communication networks, respectively, and configured to provide a service environment for controlling the audio output device to the user device, wherein the audio output device includes an audio output station including a sound figure corresponding to the sound content and a docking space to which the sound figure is docked, and configured to recognize the sound figure docked to the docking space and to output the sound content corresponding to the recognized sound figure, wherein the service environment includes a function of changing the sound content corresponding to the sound figure, and wherein the server is configured to receive a request to change the sound content corresponding to the sound figure from the user device and to process the request to change the sound content corresponding to the sound figure in consideration of a state of the audio output device.

9 Claims, 7 Drawing Sheets

(51) Int. Cl.

| | |
|---|---|
| ***A63H 3/52*** | (2022.01) |
| ***A63H 30/02*** | (2006.01) |
| ***A63H 30/04*** | (2006.01) |
| ***A63H 33/26*** | (2006.01) |
| *A63H 5/00* | (2006.01) |

(52) U.S. Cl.
CPC ..... *A63H 30/02* (2013.01); *A63H 30/04* (2013.01); *A63H 33/26* (2013.01); *A63H 5/00* (2013.01); *A63H 2200/00* (2013.01)

(56) References Cited

U.S. PATENT DOCUMENTS

| | | | | |
|---|---|---|---|---|
| 10,486,312 | B2 * | 11/2019 | Yamato | G06N 3/008 |
| 11,165,728 | B2 * | 11/2021 | Lee | H04L 51/222 |
| D1,041,582 | S * | 9/2024 | Park | D21/507 |
| 2013/0218339 | A1 * | 8/2013 | Maisonnier | B25J 13/003 700/257 |
| 2015/0024852 | A1 * | 1/2015 | Pacey | A63F 13/58 463/43 |
| 2018/0214785 | A1 * | 8/2018 | Hornsby | A63H 30/04 |
| 2018/0272240 | A1 * | 9/2018 | Soudek | A63H 3/28 |
| 2019/0126157 | A1 * | 5/2019 | Hayashi | B25J 5/007 |
| 2019/0232185 | A1 * | 8/2019 | Lin | A63H 33/086 |
| 2019/0342243 | A1 * | 11/2019 | Lee | H04M 1/725 |
| 2020/0384374 | A1 * | 12/2020 | Jeromin | A63F 13/80 |
| 2022/0084423 | A1 * | 3/2022 | Porfilio | G06K 7/10386 |
| 2024/0261698 | A1 * | 8/2024 | Blake | A63H 33/26 |
| 2025/0222368 | A1 * | 7/2025 | Park | A63H 3/28 |
| 2025/0287148 | A1 * | 9/2025 | Park | A63H 33/00 |

FOREIGN PATENT DOCUMENTS

| | | | |
|---|---|---|---|
| KR | 20180022431 | A | 3/2018 |
| KR | 101989922 | B1 | 6/2019 |
| KR | 102208256 | B1 | 1/2021 |

OTHER PUBLICATIONS

Written Opinion for International Application No. PCT/KR2023/005818.

* cited by examiner

AUDIO OUTPUT SYSTEM AND METHOD FOR CHANGING SOUND CONTENT THEREOF

CROSS-REFERENCE TO RELATED APPLICATIONS

This application is a national phase application under 35 U.S.C. § 371 of International Application No. PCT/KR2023/005818 filed May 6, 2022, which claims the benefit of and priority to Republic of Korea Patent Application No. 10-2022-0056150 filed May 6, 2022, the contents of both of which being incorporated by reference in their entireties herein.

TECHNICAL FIELD

The disclosure relates to an audio output system and a method for changing sound content thereof, which provide an operating environment in which various sounds can be easily selected by users including infants and young children and a convenient control environment in which sound content can be changed even if an audio output device is in an offline state.

BACKGROUND

The contents set forth in this section merely provide background information on the present embodiment and do not constitute prior art.

With the advancement and miniaturization of electronic devices, such as smartphones and tablets, screen time of users who use digital video devices is gradually increasing. The screen time means time spent sitting or lying down due to the use of the digital video devices, and time for physical and learning activities is excluded therefrom. Such an increase of the screen time may have bad effects on health of adult users, and may have more negative effects on users who are infants and young children. In particular, it may have undesirable effects on cerebral development that users who are infants and young children under 24 months of age are exposed to visual information for a long time, and World Health Organization (WHO) has announced an exposure guide for infants and young children suggesting that infants and young children under 1 year old must not be exposed to an electronic device screen and an electronic device screen exposure for infants and young children of 2 to 5 years old must be limited to 1 hour per day.

On the other hand, auditory stimulation may have beneficial effects on the growth and development of infants and young children who feel and learn about the world through auditory stimulation from the time they are fetuses. Various auditory stimulations have a significant impact on not only the language development but also the development of creativity and imagination of infants and young children. However, although parents desire to convey auditory stimulation to their infants and young children, there is currently a lack of means for capable of stimulating the curiosity of infants and young children who correspond to actual users and providing an easy operating environment to them, and thus the parents eventually provide the auditory stimulation to them together with visual information depending on digital video devices (TVs or smartphones).

Therefore, there has been a need for a system which can provide infants and young children with an easy operating environment in which the infants and young children can select various sounds even without going through parents' digital video devices, and can have beneficial effects on the growth and development of the infants and young children through providing various auditory stimulations to them.

An object of the present disclosure is to provide an audio output system and a method for changing sound content thereof, which include an operating environment in which various sounds can be easily selected by users including infants and young children.

An object of the present disclosure is to provide an audio output system and a method for changing sound content thereof, which provide a convenient control environment in which sound content can be changed even if an audio output device is in an offline state.

The objects of the present disclosure are not limited to the objects mentioned above, and other objects and advantages of the present disclosure that have not been mentioned can be understood by the following description and will be more clearly understood by the embodiments of the present disclosure. Further, it will be readily appreciated that the objects and advantages of the present disclosure may be realized by the means set forth in the claims and combinations thereof.

According to some aspects of the disclosure, an audio output system comprises: an audio output device configured to output sound content for auditory stimulation of infants and young children, a user device configured to control the audio output device, and a server connected to the user device and the audio output device through communication networks, respectively, and configured to provide a service environment for controlling the audio output device to the user device, wherein the audio output device includes an audio output station including a sound figure corresponding to the sound content and a docking space to which the sound figure is docked, and configured to recognize the sound figure docked to the docking space and to output the sound content corresponding to the recognized sound figure, wherein the service environment includes a function of changing the sound content corresponding to the sound figure, and wherein the server is configured to receive a request to change the sound content corresponding to the sound figure from the user device and to process the request to change the sound content corresponding to the sound figure in consideration of a state of the audio output device.

According to some aspects, the server is configured to include: a service server configured to provide the service environment to the user device; a proxy server configured to relay data between the service server and the user device or between the service server and the audio output device; and a database server configured to store data required in an operating process of the proxy server or the service server, and wherein the proxy server is configured to: check whether the audio output device is online in response to the request to change the sound content corresponding to the sound figure, store the change request in the database server if it is checked that the audio output device is in an offline state, and be provided with the change request from the database server and process the provided change request if it is checked that the audio output device is changed to an online state.

According to some aspects, the proxy server is configured to: further check whether the sound figure is docked to the audio output station of the audio output device that is checked to be in the online state, and change the sound content corresponding to the sound figure if it is checked whether the sound figure is docked.

According to some aspects, a plurality of sound figures having different appearances are provided, wherein a plural pieces of sound content are constituted to correspond to the plurality of sound figures with different types, respectively, and wherein the plurality of sound figures include a first sound figure configured to modify or rewrite the corresponding sound content, and a second sound figure of which the corresponding sound content is unable to be changed.

According to some aspects, the service environment comprises a function of generating new sound content by recording a user's voice and a function of inviting a user of another user device as a guest user and generating new sound content by recording a guest user's voice.

According to some aspects, the sound figure comprises an NFC tag, wherein the docking space includes an NFC reader, wherein the audio output device identifies a docked sound figure through near field communication, and wherein the sound figure and the docking space are fixed to each other by magnetism.

According to some aspects, the audio output device further comprises a speaker configured to output the sound content, a volume control device configured to control a volume of the speaker, an operating state light configured to indicate an operating state of the audio output station through a color change, and a playback track controller.

According to some aspects of the disclosure, a method for changing sound content of an audio output system includes: an audio output device configured to output sound content for auditory stimulation of infants and young children, a user device configured to control the audio output device, and a server connected to the user device and the audio output device through communication networks, respectively, and configured to provide a service environment for controlling the audio output device to the user device, the method comprising: a first step in which the server receives a request to change the sound content corresponding to a sound figure from the user device, and a second step in which the server processes the request to change the sound content corresponding to the sound figure in consideration of a state of the audio output device.

According to some aspects, the second step comprises: an a-th step of checking whether the audio output device is in an online state in response to the request to change the sound content corresponding to the sound figure; a b-th step of storing the change request in a database server if it is checked that the audio output device is in an offline state; and a c-th step of being provided with the change request from the database server and processing the provided change request if it is checked that the audio output device is changed to the online state.

According to some aspects, the audio output device comprises an audio output station including a sound figure corresponding to the sound content and a docking space to which the sound figure is docked, and configured to recognize the sound figure docked to the docking space and to output the sound content corresponding to the recognized sound figure, and wherein the c-th step includes the steps of: checking whether the sound figure is docked to the audio output station of the audio output device that is checked to be in the online state; and changing the sound content corresponding to the sound figure if it is checked whether the sound figure is docked.

Aspects of the disclosure are not limited to those mentioned above and other objects and advantages of the disclosure that have not been mentioned can be understood by the following description and will be more clearly understood according to embodiments of the disclosure. In addition, it will be readily understood that the objects and advantages of the disclosure can be realized by the means and combinations thereof set forth in the claims.

The audio output system and the method for changing sound content thereof according to an embodiment of the present disclosure can stimulate the curiosity of infants and young children, and can provide infants and young children with an easy operating environment in which the infants and young children can select various sounds even without going through parents' digital video devices. That is, the audio output system and the method for changing the sound content thereof according to an embodiment of the present disclosure can have beneficial effects on the growth and development of infants and young children through providing various auditory stimulations to them while minimizing a visual exposure to the digital video devices.

Further, the audio output system and the method for changing sound content thereof according to an embodiment of the present disclosure can support a control and management of an audio output device more easily by providing a convenient service environment in which sound content can be changed even if the audio output device is in an offline state.

DETAILED DESCRIPTION

Figure 1:
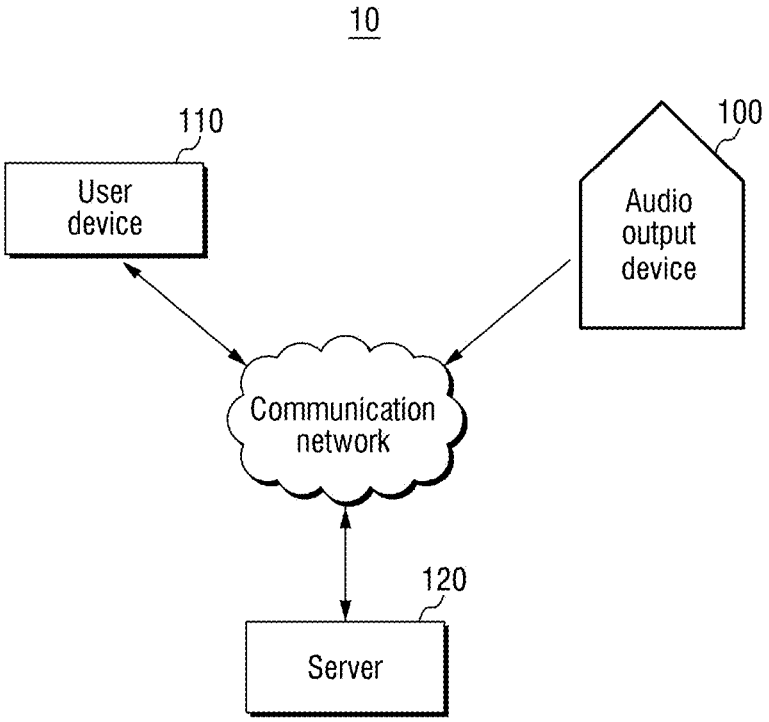
FIG. 1 is a schematic diagram illustrating an audio output system according to an embodiment of the present disclosure.

The terms or words used in the disclosure and the claims should not be construed as limited to their ordinary or lexical meanings. They should be construed as the meaning and concept in line with the technical idea of the disclosure based on the principle that the inventor can define the concept of terms or words in order to describe his/her own inventive concept in the best possible way. Further, since the embodiment described herein and the configurations illustrated in the drawings are merely one embodiment in which the disclosure is realized and do not represent all the technical ideas of the disclosure, it should be understood that there may be various equivalents, variations, and applicable examples that can replace them at the time of filing this application.

Although terms such as first, second, A, B, etc. used in the description and the claims may be used to describe various components, the components should not be limited by these terms. These terms are only used to differentiate one component from another. For example, a first component may be referred to as a second component, and similarly, a second component may be referred to as a first component, without departing from the scope of the disclosure. The term 'and/or' includes a combination of a plurality of related listed items or any item of the plurality of related listed items.

The terms used in the description and the claims are merely used to describe particular embodiments and are not intended to limit the disclosure. Singular forms are intended to include plural forms unless the context clearly indicates otherwise. In the application, terms such as "comprise," "comprise," "have," etc. should be understood as not precluding the possibility of existence or addition of features, numbers, steps, operations, components, parts, or combinations thereof described herein.

Unless otherwise defined, the phrases "A, B, or C," "at least one of A, B, or C," or "at least one of A, B, and C" may refer to only A, only B, only C, both A and B, both A and C, both B and C, all of A, B, and C, or any combination thereof.

Unless being defined otherwise, all terms used herein, including technical or scientific terms, have the same meaning as commonly understood by those skilled in the art to which the disclosure pertains.

Terms such as those defined in commonly used dictionaries should be construed as having a meaning consistent with the meaning in the context of the relevant art, and are not to be construed in an ideal or excessively formal sense unless explicitly defined in the application. In addition, each configuration, procedure, process, method, or the like included in each embodiment of the disclosure may be shared to the extent that they are not technically contradictory to each other.

Hereinafter, with reference to FIGS. 1 to 8, an audio output system and a method for changing sound content thereof according to an embodiment of the present disclosure will be described.

Figure 2:
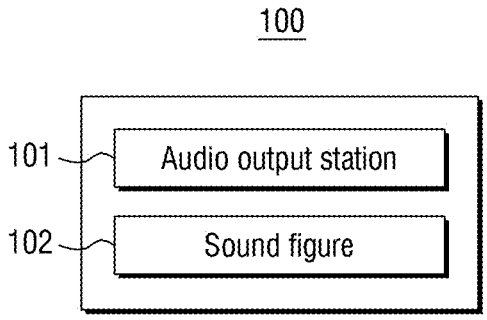
FIG. 2 is a block diagram illustrating the constitution of an audio output device according to an embodiment of the present disclosure.
Figure 3:
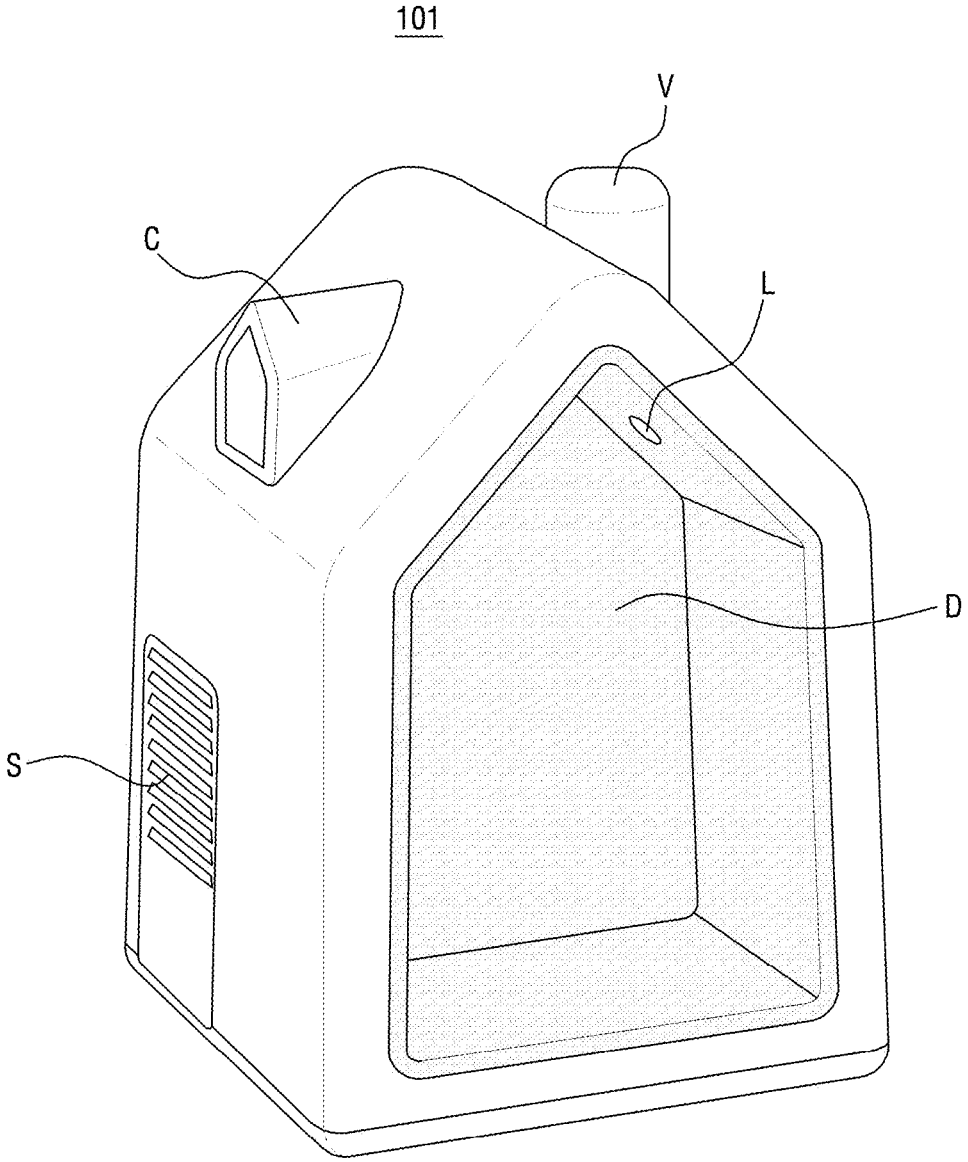
FIG. 3 exemplarily illustrates an appearance of an audio output station.
Figure 4:
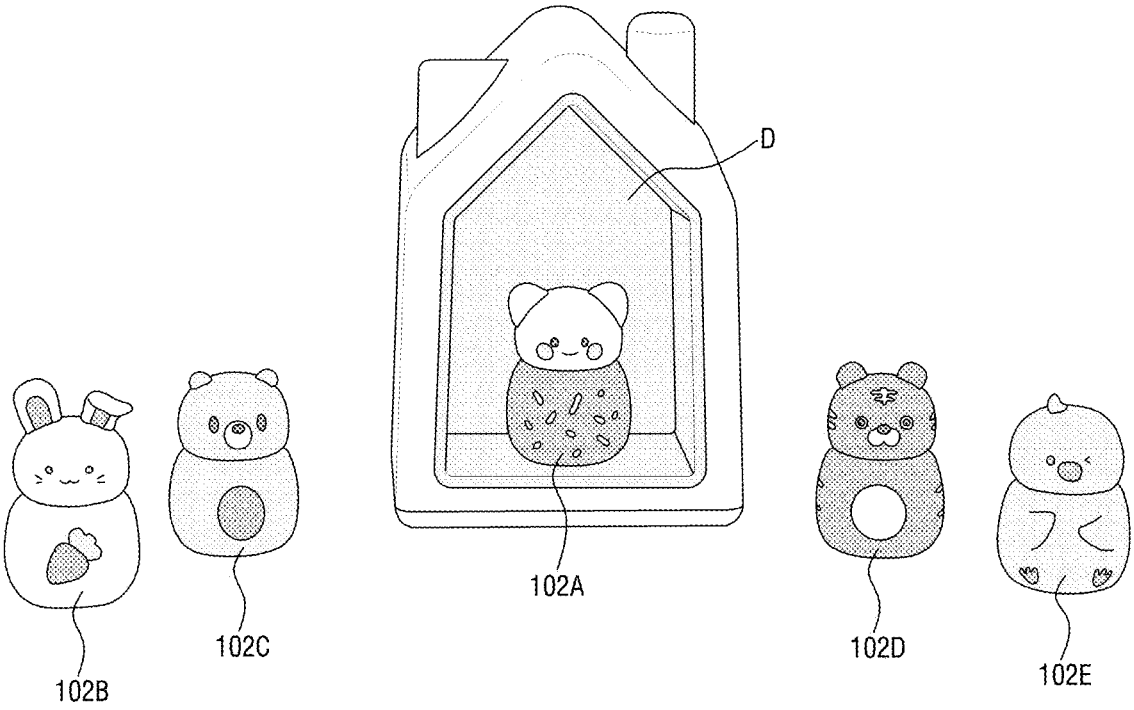
FIG. 4 exemplarily illustrates an audio output station and a plurality of sound figures.

FIG. 1 is a schematic diagram illustrating an audio output system according to an embodiment of the present disclosure. FIG. 2 is a block diagram illustrating the constitution of an audio output device according to an embodiment of the present disclosure. FIG. 3 exemplarily illustrates an appearance of an audio output station. FIG. 4 exemplarily illustrates an audio output station and a plurality of sound figures.

Referring to FIG. 1, an audio output system 10 according to an embodiment of the present disclosure includes an audio output device 100, user device 110, and a server 120.

The audio output device 100 is configured to output sound content that is changed by a user.

The user device 110 may be connected to the audio output device 100, and may control the audio output device 100. The user device 110 means a communication terminal which can use a web service in a wired/wireless communication environment or which can operate an app that provides a service of the server 120. For example, the user device 110 may be a user's personal computer or a portable terminal.

Here, users of the audio output device 100 and users of the user device 110 may include infants and young children and parents of them. In the present specification, users who are infants and young children may mean infants who are equivalent to children under 3 years old and young children from 3 to 8 years old. The infant or the young child may be a main user of the audio output device 100, and the parent may be a main user of the user device 110. However, this explanation is merely exemplary, and the embodiments are not limited thereto.

The server 120 may provide a service environment in which the user device 110 controls the audio output device 100, and may provide sound content that is outputted by the audio output device 100. That is, the server 120 may perform hosting of sound content, and may provide the sound content that matches information that is recognized through the audio output device 100 to the audio output device 100.

A communication network may connect the server 120, the audio output device 100, and the user device 110 with one another. For example, the communication network provide an access path so that the user device 110 can transmit and receive packet data after accessing the server 120 and/or the audio output device 100. The communication networks may include, for example, wired networks, such as local area networks (LANs), wide area networks (WANs), metropolitan area networks (MANs), and integrated service digital networks (ISDNs), or wireless networks, such as wireless LANs, CDMA, Bluetooth, satellite communications, 3G, 4G, and 5G, but the scope of the present disclosure is not limited thereto.

Referring to FIG. 2, the audio output device 100 includes an audio output station 101 and a sound figure 102.

The user may dock the sound figure 102 to the audio output station 101, and as the sound figure 102 is docked to the audio output station 101, corresponding sound content is outputted. That is, the sound figure 102 plays a key role of sound content playback.

The audio output station 101 may have an appearance in which a docking space D is formed to allow the sound figure 102 to be seated therein, and may include a speaker configured to output the sound content, a volume control device V configured to control the volume of the speaker, an operating state light L that indicates the operating state of the audio output station through a color change, and a playback track controller C configured to change a sound track being outputted. For example, the color of the operating state light L that lights up may differ depending on whether the sound figure 102 is docked. Further, the audio output station 101 may have an appearance that can stimulate the curiosity of the user who is the infant or a young child. Referring to FIG. 3, it can be known that the audio output station 101 may have the same appearance as a house in which the docking space D is formed, the volume control device V is constituted as the chimney of the house, and the playback track controller C is constituted as a part of the roof of the house. The user who is an infant or a young child can locate the sound figure 102 in the docking space of the audio output station 101 while purely recognizing that the sound figure 102 resides in the audio output station 101. The audio output station 101 in the shape of a house can give the user who is an infant or a young child emotional stability and satisfaction.

The sound figure 102 may correspond to the sound content constituted for auditory stimulation of infants and young children. In an embodiment, the sound content may be at least one of content for language learning, such as counting of figures, bilingual repetition, onomatopoeia repetition, and mimetic word repetition; content for improving user's imagination and creativity, such as melody, sound theater, and folktales; content for enabling a user to perform physical activities through rhythm, such as animal songs and rhythmic children's songs; and content in which parents have recorded their voices for user's emotional development. One sound content may be composed of a plurality of sound tracks, and each sound track may be the same type auditory stimulus sound.

In an embodiment, a plurality of sound figures 102 with different appearances may be provided, and in this case, the plurality of sound figures 102 may correspond to different types of plural pieces of sound content. That is, the plurality of sound figures 102 with different appearances may be constituted to correspond to different types of auditory stimulus sound content of infants and young children. One of the plurality of sound figures 102 may be selected by the user, and may be seated in the docking space D. The docking space D of the audio output station 101 and the sound figure 102 may include magnets, and may be fixed to each other by magnetism, but such a fixing means is not limited to the magnetism. The plurality of sound figures 102 may be formed with a size that is large enough for the user who is an infant or a young child to hold with one hand, and the docking space D may be formed with a size that sufficiently accommodates the sound figure 102 therein. The plurality of sound figures 102 may be constituted to have different shapes, and may be constituted in one of an animal shape, a cute character shape, and a widely known character shape so as to be able to stimulate the curiosity of the user who is an infant or a young child. Further, for safety of the user who is an infant or a young child, the plurality of sound figures 102 may be formed with their edges rounded rather than sharp.

Referring to FIG. 4, it can be known that the overall appearance of the plurality of sound figures 102 is round, and the figures 102 are constituted to have different shapes, such as a cute character 102A, a rabbit 102B, a bear 102C, a tiger 102D, and a chick 102E. Further, the sound figures 102 may correspond to different pieces of auditory stimulus sound content of infants and young children in a manner that, for example, the cute character 102A is constituted to correspond to the content in which the parent's voice is recorded, the rabbit 102B is constituted to correspond to Korean and English world masterpiece fairytale content, the bear 102C is constituted to correspond to Korean and English children's songs, the tiger 102D is constituted to correspond to folktales, and the chick 102E is constituted to correspond to rhythmic children's songs.

The user who is an infant or a young child can safely select the sound figure 102 with one hand, can easily make the selected sound figure 102 seated in the docking space of the audio output station 101, and may also be able to remove the seated sound figure 102 with one hand.

The audio output station 101 may identify the seated sound figure 102 through near field communication (NFC). The plurality of sound figures 102 may include NFC tags, respectively, and the docking space D may include an NFC reader.

The audio output station 101 may include a data processing unit, a data storage unit, and a communication unit. The data processing unit may control processes of recognizing whether the sound figure 102 is docked, identifying the NFC tag of the docked sound figure 102, and outputting the sound content corresponding to the identified sound figure 102. The data storage unit may store data required in the operating process of the data processing unit. The communication unit may perform data exchange with the data processing unit and the server 120.

The data processing unit may check whether the sound figure 102 is docked, and may reflect the checked state in the operating state light L. Further, the data processing unit may control to output the sound content corresponding to the identified sound figure 102 through the speaker S. Specifically, the data processing unit may check whether the sound content corresponding to the identified sound figure 102 is stored in the data storage unit of the audio output station 101. If the corresponding sound content is not stored, the data processing unit may request the corresponding sound content from the server 120 through the communication unit, may be provided with the corresponding sound content from the server 120, and may store the provided sound content in the data storage unit. The data processing unit may be provided with the sound content corresponding to the identified sound figure 102 from the data storage unit, and may output the provided sound content through the speaker S.

In another example, the sound content may be included in the sound figure 102. The data processing unit may be provided with the sound content included in the sound figure 102 through the near field communication, and may output the provided sound content through the speaker S.

The audio output device 100 may output the sound content corresponding to the sound figure 102 as the sound figure 102 is docked to the audio output station 101. Further, as the docked sound figure is removed from the docking space, the output of the sound content may be stopped, and if another sound figure is docked, the sound content corresponding to the docked sound figure is outputted. The sound content output process of the audio output device 100 is composed of simple docking and removal processes only, and thus the users who are infants and young children may also be able to sufficiently perform the operation process. Further, since the sound content can be stored in the audio output station 101 in advance even without any connection with other devices, the output of the sound content corresponding to the sound FIG. 102 can be performed only by the audio output device 100.

According to some embodiments, in case that the same sound figure 102 is repeatedly docked to and is removed from the audio output station 101, the audio output station 101 may continuously play the sound content. In other words, in case that the sound figure 102 is removed from the docking space D, and then is docked thereto again, the audio output station 101 can continuously play the sound content that was outputted before the sound figure 102 is removed from the docking space D. For example, in case that the sound figure of the rabbit 102B has been docked in the audio output station 101, the audio output station 101 may output the sound content corresponding to the sound figure of the rabbit 102B. In this case, if the sound figure of the rabbit 102B is removed from the audio output station 101, the audio output station 101 may temporarily stop the playback of the sound content corresponding to the sound figure of the rabbit 102B. If the sound figure of the rabbit 102B is docked again to the audio output station 101, the audio output station 101 may output the sound content that corresponds to the sound figure of the rabbit 102B again from the point where the sound content was previously stopped.

According to some embodiments, the sound figure 102 may change the corresponding sound content. That is, at least one of the number, the types, and the order of sound tracks included in the sound content may be changed by the user. The change of the sound content may be performed by the user who accesses the service environment that is provided by the server 120 through the user device 110. The user may provide a request to change the sound content and data related to a newly added sound track to the server 120 through the user device 110, and the server 120 may change the sound content that corresponds to the sound figure by providing the data provided from the user device 110 to the audio output station 101.

Here, the change of the sound content that corresponds to the sound figure 102 may be determined in consideration of the operating state of the audio output station 101. Further, in case that a plurality of sound figures 102 are provided, the plurality of sound figures 102 may include a first sound figure (rewritable) constituted to correct or rewrite the sound content that corresponds to the plurality of sound figures 102 and a second sound figure of which the sound content is unable to be changed. The sound content that corresponds to the first sound figure is rewritable, but the sound content that corresponds to the second sound figure is in a designated state, and thus is unchangeable. Exemplarily, among the plurality of sound figures 102A to 102E of FIG. 4, the cute character sound figure 102A may correspond to the first sound figure, and the remaining sound figures 102B to 102E may correspond to the second sound figures. In a state where the first sound figure is docked to the audio output station 101, the change of the corresponding sound content may be performed, whereas in a state where the second sound figure is docked to the audio output station 101, the change of the corresponding sound content may not be performed. However, the explanation of the first sound figure and the second sound figures is merely exemplary, and the embodiments are not limited thereto. Of course, the second sound figure may also be implemented so that the change of the corresponding sound content is performed. For example, the first sound figure may be implemented so that the recorded sound content recorded by the user can be uploaded, and the second sound figure may be implemented so that the corresponding sound content can be changed through subscription of the content server or downloading of the content server.

Hereinafter, referring to FIGS. 5 to 7, a service environment that is provided by the server 120 and processes for changing sound content that is performed through such a service environment will be described in more detail.

Figure 5:
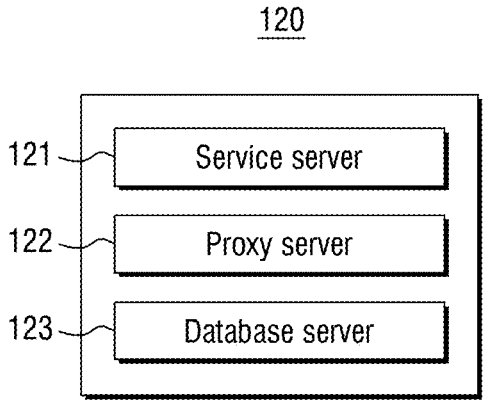
FIG. 5 is a block diagram illustrating the constitution of a server according to an embodiment of the present disclosure.

FIG. 5 is a block diagram illustrating the constitution of a server according to an embodiment of the present disclosure. FIGS. 6 and 7 illustrate processes for changing sound content of an audio output system according to an embodiment of the present disclosure.

Referring to FIG. 5, the server 120 includes a service server 121, a proxy server 122, and a database server 123.

The server 120 according to an embodiment may have aspects that are wholly hardware, or that are partly hardware and partly software. For example, the service server 121, the proxy server 122, and the database server 123 included in the server 120 may refer collectively to devices for sending and receiving data of specific format and contents through electronic communications and software related to the devices. In the present specification, the term "unit", "module", "server", "system", or "equipment" is intended to refer to a combination of hardware and software that is driven by the corresponding hardware. Here, the hardware may be, for example, a data processing device including a CPU or another processor. Further, the software that is driven by the hardware may refer to a process being executed, object, executable, thread of execution, or program.

The service server 121 may provide a service environment for connection and control of the audio output device 100 to the user device 110, and may provide the sound content requested from the audio output device 100.

The proxy server 122 may relay data between the service server 121 and a client of the user device 110. That is, the service server 121 may be located inside a firewall that is constituted by the server 120, and data exchange with an outside is performed preferentially through the proxy server 122. The proxy server 122 may store partial information that is requested from the client to the service server 121 by using a cache. Exemplarily, information that the user of the user device 110 has once used through the service environment is stored in the proxy server 122, and if the information is requested again thereafter, the proxy server 122 provides the stored information to the user. Accordingly, network traffics between the server 120 and an external device can be reduced, and the data transmission time can be improved.

The database server 123 is constituted to store data required in the operating process of the proxy server 122 or the service server 121.

The service environment that is provided by the service server 121 to control the audio output device 100 may be provided through an application program having been installed in the user device 110. Here, the application program may include, for example, an app that is executed in mobile equipment (smartphone) or a client program installed in a computer device. However, the application program is not limited thereto, and the service server 121 may send and receive data to and from the user device 110 in a data transmission method through a web document. In this case, the web document refers to arbitrary data that is provided so as to be available for viewing and/or modification by being transmitted through a web site having a specific network address with the type or form thereof unlimited. In this case, the service server 121 may be a web server that provides a web page having a specific uniform resource locator (URL), and the user device 110 can use the service environment that is provided by the service server 121 by accessing the corresponding web page by using a web browser. The web document format may be hypertext markup language (HTML), extensible markup language (XML), JavaScript object notation (JSON), or a format based on other different languages, and is not limited to a specific format. The user may use the service environment that is provided by the service server 121 by accessing the application program or web environment through the user device 110.

The user may register the audio output device 100 connected in the service environment on a user's own account, or may enter basic information or may perform other changes. Further, the user may generate a new sound track through the service environment. Here, the new sound track may be generated by recording the user voice. The user device 110 may further include a recording unit, and the service environment may provide a function of generating the new sound track by recording the user voice through the recording unit. Further, the service environment may invite a user of other user device as a guest user, and may provide a function of generating a new sound track by recording the guest user's voice. That is, the other user invited as the guest user may be set as a family member of the user of the user device 110, and the service server 121 may give the guest user permission to generate a new sound track through voice recording. Through such guest invitation and guest recording functions, voices of other users who live far away may be generated as the sound content, and thus more diverse pieces of auditory stimulation sound content may be provided to the users who are infants and young children.

Further, the service environment may provide a function of changing the sound content corresponding to the sound figure 102. Here, in case that a plurality of sound figures 102 are provided, a function of modifying the sound content corresponding to the first sound figure may be provided. The service environment may provide a function of modifying at least one of the types, the number, and the order of sound tracks included in the sound content corresponding to the first sound figure.

As the service environment provides the above-described function, the sound content included in the user device 110 may be changed to correspond to the sound figure 102. The user may determine the sound content corresponding to the sound figure 102 through a user interface that is provided by the service environment. For example, the user may select the recorded user's voice sound track and the family voice sound track as the sound content corresponding to the sound figure 102, and may provide a request to change the selected sound content to the sound content corresponding to the sound figure 102 to the server 120. The request to change the sound content may include the sound data corresponding to the sound track in accordance with the user's selection.

Figure 6:
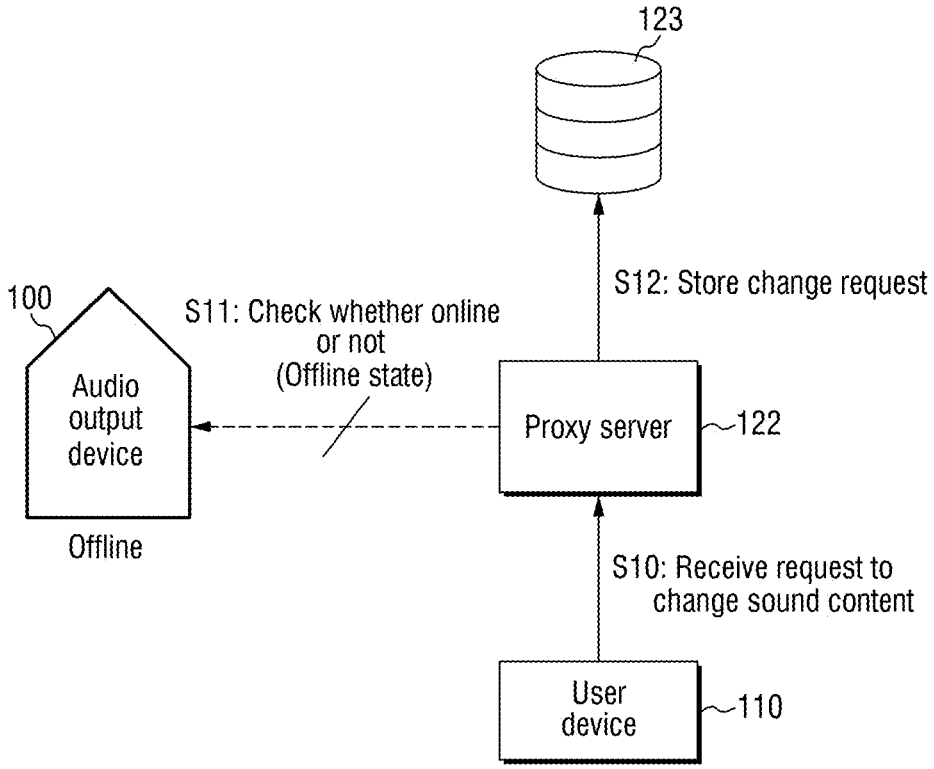
FIGS. 6 and 7 illustrate processes for changing sound content of an audio output system according to an embodiment of the present disclosure.

Referring to FIG. 6, the request to change the sound content corresponding to the sound figure that is provided from the user device 110 may be preferentially transferred to the proxy server 122 (S10). The proxy server 122 may perform the change of the sound content corresponding to the sound figure in consideration of the state of the audio output device 100. Here, the state of the audio output device 100 that is checked by the proxy server 122 may be whether data exchange through a communication network is possible with the audio output device 100. The proxy server 122 checks whether the audio output device 100 is online in response to the change request (S11). If it is checked that the audio output station is in an offline state, the proxy server 122 stores the change request in the database server (S12). That is, if it is checked that the state of the audio output device 100 is offline, the proxy server 122 may temporarily store data corresponding to the request to change the sound content in the database server 123, and may determine delayed processing of the change request. Further, in some embodiments, if it is checked that the state of the audio output device 100 is offline, the proxy server 122 may support the user in changing the audio output device 100 to an online state by transmitting a message for requesting to check the state of the audio output device 100 to the user device 110.

Figure 7:
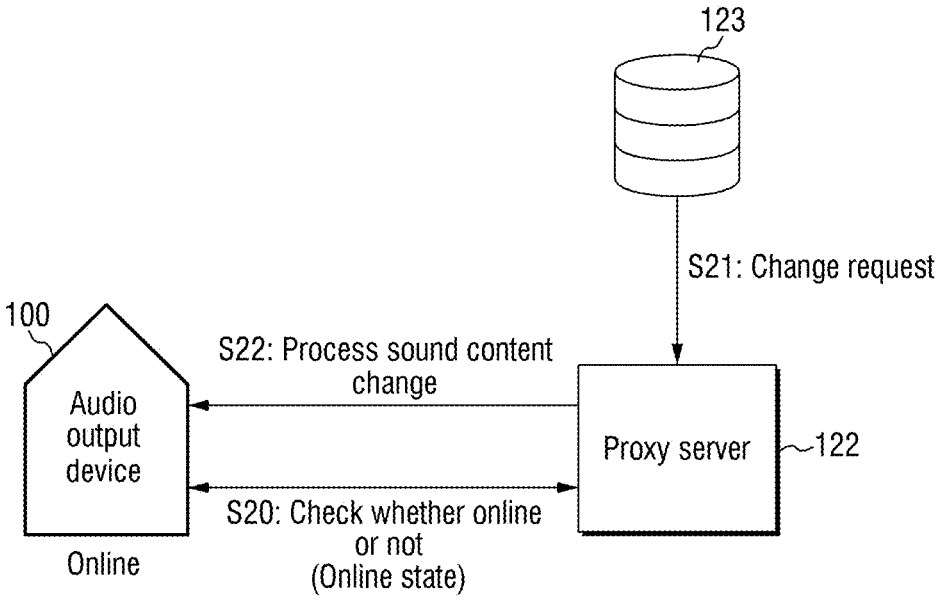

Referring to FIG. 7, the proxy server 122 may perform checking of the state of the audio output device 100 and whether the state of the audio output device 100 is online in accordance with a predetermined period or a predetermined time. If it is checked whether the audio output device 100 is online (S20), the proxy server 122 is provided with the change request from the database server 123 (S21), and provides the provided change request to the audio output device 100 to process the provided change request (S22). For example, the proxy server 122 may provide the change request to the audio output device 100 by using a messaging protocol based on a message queuing telemetry transport (MQTT).

In some embodiments, the proxy server 122 may further check whether the sound FIG. 102 is docked to the audio output station 101. That is, if it is checked whether the sound figure is docked, the proxy server 122 may change the sound content corresponding to the sound FIG. 102. Further, if the sound figure 102 is provided to include a first sound figure and a second sound figure, the proxy server 122 may check whether the first sound figure is docked to the audio output station 101. If it is checked that the second sound figure rather than the first sound figure is docked, the proxy server 122 may not perform the processing of the corresponding sound content. In an embodiment, if it is checked that the sound figure 102 is not docked, the proxy server 122 may support that the sound figure 102 is docked by the user by transmitting a message for requesting the docking of the sound figure 102 to the user device 110. Further, in an embodiment, if it is checked that the second sound figure rather than the first sound figure is docked, the proxy server 122 may transmit a message for requesting the docking of the first sound figure to the user device 110.

In other some embodiments, the proxy server 122 may perform the change processing of the sound content in a background environment of the audio output station 101 regardless of whether the sound figure 102 is docked to the audio output station 101.

The audio output system according to an embodiment of the present disclosure may stimulate the curiosity of infants and young children, and may provide an easy operating environment for infants and young children in which the infants and young children can select various sounds even without going through parents' digital video devices. That is, the audio output system according to an embodiment of the present disclosure may have beneficial effects on the growth and development of the infants and young children by providing various auditory stimulations to them while minimizing visual exposure to the digital video devices.

Further, the audio output system according to an embodiment of the present disclosure may support the control and management of the audio output device more easily by providing a convenient service environment in which the sound content can be changed even if the audio output device is in an offline state.

Hereinafter, a method for changing sound content of an audio output system according to another embodiment of the present disclosure will be described.

Figure 8:
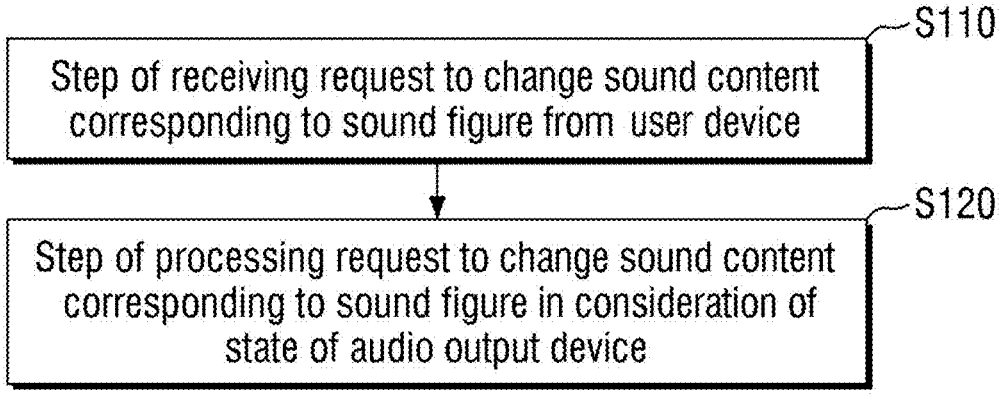
FIG. 8 is a flowchart of a method for changing sound content of an audio output system according to an embodiment of the present disclosure.

FIG. 8 is a flowchart of a method for changing sound content of an audio output system according to an embodiment of the present disclosure.

The method for changing sound content according to the present embodiment may be performed by the audio output system 10 according to FIGS. 1 to 7. For explanation of the method for changing sound content according to the present embodiment, FIGS. 1 to 7 and related explanations may be referred to.

Referring to FIG. 8, the method for changing sound content of the audio output system according to an embodiment of the present disclosure includes the steps of: receiving a request to change the sound content corresponding to a sound figure from a user device (S110); and processing the request to change the sound content corresponding to the sound figure in consideration of a state of an audio output device (S120), and the above steps may be performed by a server 120.

First, a request to change the sound content corresponding to the sound figure 102 is received from the user device (S110).

A service environment from the server 120 may provide a function of changing the sound content corresponding to the sound figure 102 to the user device 110. Here, in case that a plurality of sound figures 102 are provided, a function of modifying the sound content corresponding to the first sound figure may be provided. That is, the service environment may provide a function of modifying at least one of the types, the number, and the order of sound tracks included in the sound content corresponding to the first sound figure.

The user may determine the sound content corresponding to the sound figure 102 through a user interface that is provided by the service environment. For example, the user may select the recorded user's voice sound track and the family voice sound track as the sound content corresponding to the sound figure 102, and may provide a request to change the selected sound content to the sound content corresponding to the sound figure 102 to the server 120. The request to change the sound content may include the sound data corresponding to the sound track in accordance with the user's selection, and the server 120 may receive the request to change the sound content corresponding to the sound figure from the user device.

Next, the request to change the sound content corresponding to the sound figure is processed in consideration of the state of the audio output device (S120).

The server 120 may include a service server 121, a proxy server 122, and a database server 123, and the service server 121 may provide a service environment for connection and control of the audio output device 100 to the user device 110, and may provide the sound content requested from the audio output device 100. The proxy server 122 may relay data between the service server 121 and the client of the user device 100. The database server 123 is configured to store data required in an operating process of the proxy server 122 or the service server 121.

The request to change the sound content corresponding to the sound figure that is provided from the user device 110 may be preferentially transferred to the proxy server 122, and the proxy server 122 may perform the changing of the sound content corresponding to the sound figure in consideration of the state of the audio output device 100.

The present step (S120) may include the steps of: checking whether the audio output device is in an online state in response to the request to change the sound content corresponding to the sound figure; storing the change request in the database server if it is checked that the audio output device is in an offline state; and being provided with the change request from the database server and processing the provided change request if it is checked that the audio output device is changed to the online state.

In an embodiment, if it is checked that the state of the audio output device 100 is offline, the server 120 may support that the user changes the audio output device 100 to the online state by transmitting a message for requesting to check the state of the audio output device 100 to the user device 110.

Here, the step of being provided with the change request from the database server and processing the provided change request if it is checked that the audio output device is changed to the online state may include the steps of: checking whether the sound figure is docked to the audio output station of the audio output device that is checked to be in the online state; and changing the sound content corresponding to the sound figure if it is checked whether the sound figure is docked. In an embodiment, if it is checked that the sound figure 102 is not docked, the proxy server 122 may support that the sound figure 102 is docked by the user by transmitting a message for requesting the docking of the sound figure 102 to the user device 110.

The operations by the method for changing the sound content of the audio output system according to the embodiments as described above may be implemented by a computer program at least partly, and may be written in a computer readable recording medium. The computer readable recording medium in which the program for implementing the operations by the method for changing the sound content of the audio output system according to the embodiments is written includes all types of recording devices in which computer readable data is stored. Examples of the computer readable recording medium are flash memory type, hard disk type, multimedia card micro type, and card type memories (e.g., SD or XD memory), RAM, and ROM. Further, in the computer readable recording medium, computer readable codes which are distributed to computer systems connected through networks and which can be read by the computer in a distributed manner may be stored and executed. Further, functional programs, codes, and code segments for implementing the present embodiment will be able to be easily understood by those of ordinary skill in the art to which the present embodiment pertains. The computer program may be composed of a set of instructions that can be executed by the above-described computer, and may have different names depending on the type of the computer. For example, if the computer type is a smartphone, the computer program may be referred to as an app.

While the inventive concept has been particularly shown and described with reference to exemplary embodiments thereof, it will be understood by those of ordinary skill in the art that various changes in form and details may be made therein without departing from the spirit and scope of the inventive concept as defined by the following claims. It is therefore desired that the embodiments be considered in all respects as illustrative and not restrictive, reference being made to the appended claims rather than the foregoing description to indicate the scope of the disclosure.

The invention claimed is:

1. An audio output system comprising:

in both online and offline states, an audio output device configured to output first sound content;

a user device configured to control the audio output device; and a server configured to communicate with the user device and the audio output device through communication networks, respectively, and to provide a service environment for controlling the audio output device to the user device, wherein the audio output device includes an audio output station including a sound figure corresponding to the first sound content and a docking space to which the sound figure is docked, and configured to recognize the sound figure docked to the docking space and to output the first sound content corresponding to the recognized sound figure, wherein the service environment includes a function of changing the first sound content corresponding to the sound figure, and wherein the server is configured to;

receive a request to change the first sound content corresponding to the sound figure from the user device, process the request to change the first sound content corresponding to the sound figure in consideration of a state of the audio output device, based on the audio output device being in the online state, the audio output device, while the sound figure is docked in the docking space, changes the first sound content stored in the sound figure to second sound content according to the request, and in the offline state, the audio output device outputs the second sound content stored in the sound figure based on the sound figure being docked in the docking space.

2. The audio output system of claim 1, wherein the server is configured to include: a service server configured to provide the service environment to the user device; a proxy server configured to relay data between the service server and the user device or between the service server and the audio output device; and a database server configured to store data required in an operating process of the proxy server or the service server, and wherein the proxy server is configured to: check whether the audio output device is in the online state or the offline state, in response to the request to change the first sound content corresponding to the sound figure, store the change request in the database server if it is checked that the audio output device is in the offline state, and be provided with the change request from the database server and process the provided change request if it is checked that the audio output device is changed to the online state.

3. The audio output system of claim 1, wherein a plurality of sound figures having different appearances are provided, wherein a plural pieces of sound content comprising the first sound content are constituted to correspond to the plurality of sound figures with different types, respectively, and wherein the plurality of sound figures include a first sound figure configured to modify or rewrite the corresponding sound content, and a second sound figure of which the corresponding sound content is unable to be changed.

4. The audio output system of claim 1, wherein the service environment comprises a function of generating new sound content by recording a user's voice and a function of inviting a user of another user device as a guest user and generating new sound content by recording a guest user's voice.

5. The audio output system of claim 1, wherein the sound figure comprises an NFC tag, wherein the docking space includes an NFC reader, wherein the audio output device identifies a docked sound figure through near field communication, and wherein the sound figure and the docking space are fixed to each other by magnetism.

6. The audio output system of claim 5, wherein the audio output device further comprises a speaker configured to output the sound content, a volume control device configured to control a volume of the speaker, an operating state light configured to indicate an operating state of the audio output station through a color change, and a playback track controller.

7. A method for changing sound content of an audio output system including: In both online and offline states, an audio output device configured to output sound content for auditory stimulation of infants and young children; a user device configured to control the audio output device; and a server connected to the user device and the audio output device through communication networks, respectively, and configured to provide a service environment for controlling the audio output device to the user device, the method comprising:

a first step in which the server receives a request to change the sound content corresponding to a sound figure from the user device; and a second step in which the server processes the request to change the sound content corresponding to the sound figure in consideration of a state of the audio output device and based on the audio output device being in the online state, the audio output device, while the sound figure is docked in the docking space, changes the first sound content stored in the sound figure to second sound content according to the request, and in the offline state, the audio output device outputs the second sound content stored in the sound figure based on the sound figure being docked in the docking space.

8. The method of claim 7, wherein the second step comprises: an a-th step of checking whether the audio output device is in the online state or the offline state, in response to the request to change the first sound content corresponding to the sound figure; a b-th step of storing the change request in a database server if it is checked that the audio output device is in the offline state; and a c-th step of being provided with the change request from the database server and processing the provided change request if it is checked that the audio output device is changed to the online state.

9. The method of claim 8, wherein the audio output device comprises an audio output station including a sound figure corresponding to the first sound content and a docking space to which the sound figure is docked, and configured to recognize the sound figure docked to the docking space and to output the first sound content corresponding to the recognized sound figure.

* * * * *